US005603627A

United States Patent [19]

Evanisko

[11] Patent Number: 5,603,627

[45] Date of Patent: Feb. 18, 1997

[54] COLD CATHODE LAMP LAMPHOLDER

[75] Inventor: Jim Evanisko, Hasbrouck Heights, N.J.

[73] Assignee: National Cathode Corp., New York, N.Y.

[21] Appl. No.: 517,913

[22] Filed: Aug. 22, 1995

[51] Int. Cl.[6] ..... H01R 33/02

[52] U.S. Cl. ..... 439/235; 439/95; 439/936

[58] Field of Search ..... 439/226–244, 439/682, 683, 535, 936

[56] References Cited

U.S. PATENT DOCUMENTS

| | | | |
|---|---|---|---|
| 602,966 | 4/1898 | Wallach | 362/219 |
| 1,117,084 | 11/1914 | Phelps | 439/535 |
| 1,875,179 | 8/1932 | Prouty | 439/235 |
| 2,045,229 | 6/1936 | Hough | 439/235 |
| 2,374,228 | 4/1945 | Miller | 439/235 |
| 2,620,372 | 12/1952 | Goddard | 439/235 |
| 2,644,027 | 6/1953 | Caferro | 174/52 |
| 2,644,911 | 7/1953 | Hultgren | 315/187 |
| 3,753,027 | 8/1973 | Kolkman | 313/318 |
| 4,211,464 | 7/1980 | Lee | 439/535 |
| 4,799,134 | 1/1989 | Pinch | 362/217 |
| 5,194,021 | 3/1993 | Oba et al. | 439/936 |
| 5,370,546 | 12/1994 | Evanisko | 439/226 |
| 5,413,501 | 5/1995 | Munn | 439/535 |

*Primary Examiner*—Hien Vu
*Attorney, Agent, or Firm*—Schweitzer Cornman Gross

[57] ABSTRACT

A lampholder for use with cold cathode lamps intended to be wired in a parallel configuration includes an insulating bulb-end receptacle mounted in a conductor housing. The receptacle is divided into a pair of individual bulb-end receiving portions, each of which is provided with a conductive clip which establishes electrical contact with an inserted bulb. The clips can be configured into a plurality of electrical configurations to allow both single and dual lamp operation to be achieved.

6 Claims, 4 Drawing Sheets

FIG.1
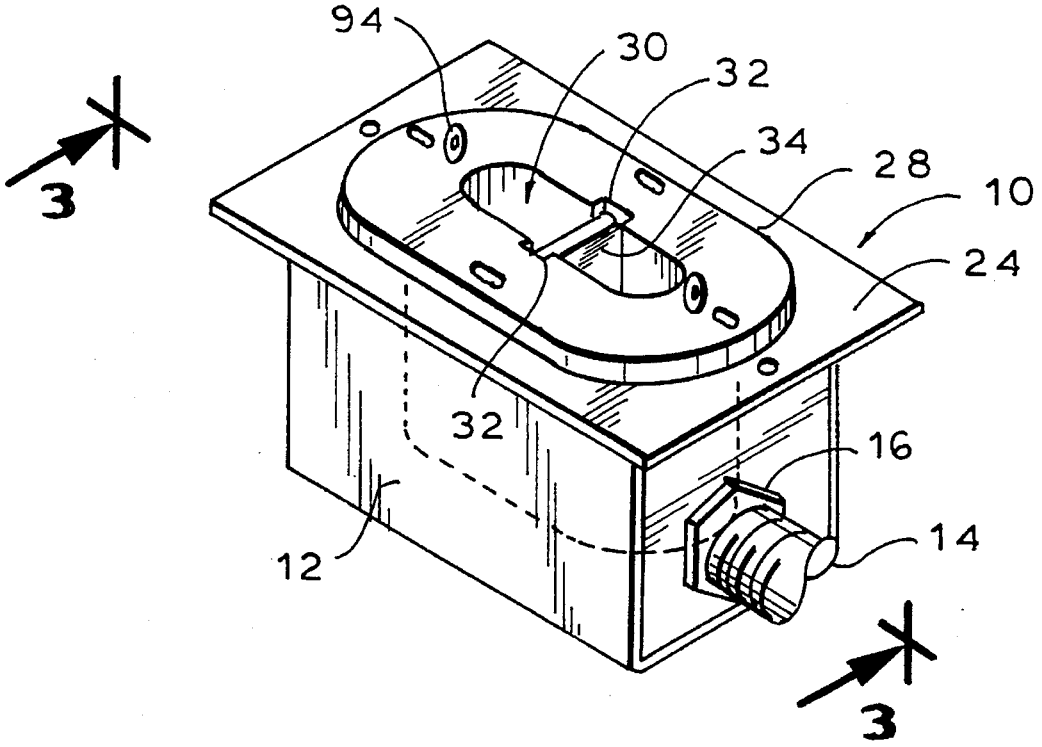
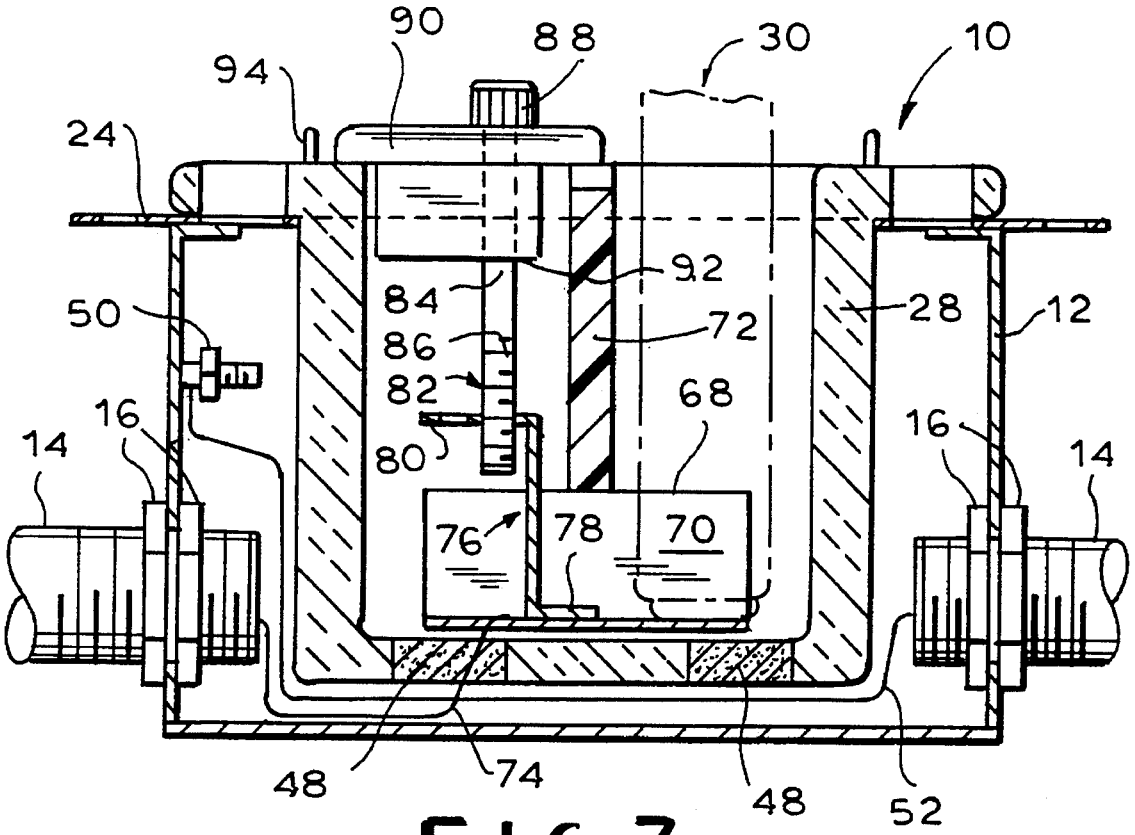
FIG.7

COLD CATHODE LAMP LAMPHOLDER

The present invention relates to a new and improved lampholder to be used with cold cathode lamps.

BACKGROUND OF THE INVENTION

Cold cathode lighting is used as an architectural lighting tool due to its great flexibility. Cold cathode lamps are generally in the form of elongated glass tubes filled with a luminescent gas which, when energized, emits a light of a particular color dependent upon the composition of the coating of the tube. Each end of the tube is provided with an electrode to allow the bulb to be connected into a lighting circuit by connection through bulb receptacles.

Such lamps may be arrayed either in a series or parallel circuit configuration. The series configuration requires a high voltage, typically in excess of 1000 volts, to be employed. The utilization of such a voltage level effectively prevents the use of a series lamp arrangement in certain locations. The National Electrical Code (NEC) prohibits the use of high voltage circuits in residential dwellings. In addition, the NEC prohibits the use of such high voltage circuits in an installation below 8'6"from ground or floor level.

A parallel circuit configuration for cold cathode lighting can operate at voltages below 1000 volts, and thus can be incorporated in locations where a series arrangement is prohibited. It is thus the purpose of the present invention to provide a new and improved lampholder for cold cathode lamps which may be utilized in connection with low voltage, parallel configuration lighting circuits, and which can be utilized as both a single and dual lampholder, allowing a variety of circuit configurations to be utilized.

SUMMARY OF THE INVENTION

In accordance with the purposes and principles of the present invention, a cold cathode lamp lampholder is provided in the form of an outer conductive housing adapted to be interconnected with other housing and support elements in a manner by which a continuous ground may be provided for the lamp circuit. Mounted and electrically isolated within the conductive housing is an insulating lamp end receptacle having an internal recess dimensioned to accept a pair of cold cathode lamp electrode ends. The combination of the outer conductive housing and insulated lamp end receptacle create an internal wiring compartment therebetween which is sealed to prevent moisture entry. Lamp electrode contacts are provided within the insulated receptacle in a manner which allows either independent or common electrical contact to be established with the electrodes of a pair of lamp ends inserted therein, and which further permit a portion of the receptacle recess to be closed off when the receptacle is used with a single bulb, allowing the lampholder to be used with both single and dual bulb arrangements.

A fuller understanding of the present invention will be achieved upon consideration of the following detailed description of a preferred, but nonetheless illustrative embodiment of the invention, when reviewed in conjunction with the annexed drawings, wherein:

FIG. 1 is a perspective view of a lampholder in accordance with the present invention;

FIG. 7 is an elevation view in section taken along a line equivalent to line 3–3 of FIG. 1 showing a second alternative embodiment.

DETAILED DESCRIPTION OF THE INVENTION

Figure 2:
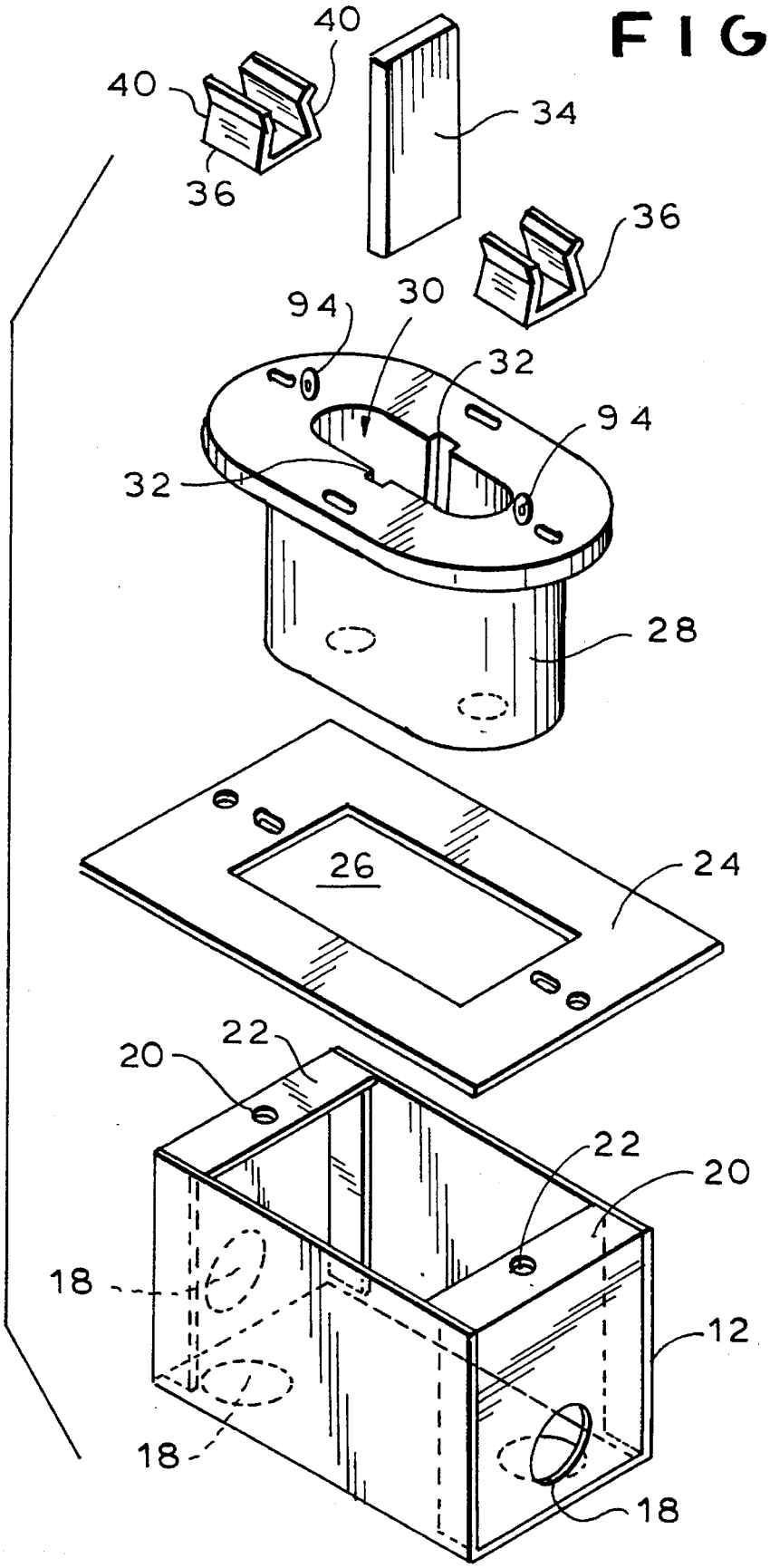
FIG. 2 is an exploded perspective view thereof.

Referring initially to FIGS. 1 through 5, a cold cathode lampholder 10 constructed in accordance with the present invention comprises shell or box 12, typically formed of steel or aluminum, as known in the art. The box walls may be provided with one or more scored or partially cut areas 18, best seen in FIG. 2, to allow the attachment of connecting components, such as the end of a section of conduit 14, which is typically mounted to a box wall by the use of a pair of nuts 16. The top of the box is open, and is provided with a pair of opposed ledges 20 having threaded bores 22 to allow the mounting of components upon the open face. As shown, the box is provided with a mounting plate 24, typically of planar dimension somewhat larger than the top dimensions of the box 12. The mounting plate 24 has a central aperture 26 to allow mounting of an insulated bulb end receptacle 28, as known in the art. Upon assembly, the combination of box, mounting plate and receptacle is sealed to provide a moisture-resistant housing for connecting leads between the receptacle and the lighting system wiring.

Figure 3:
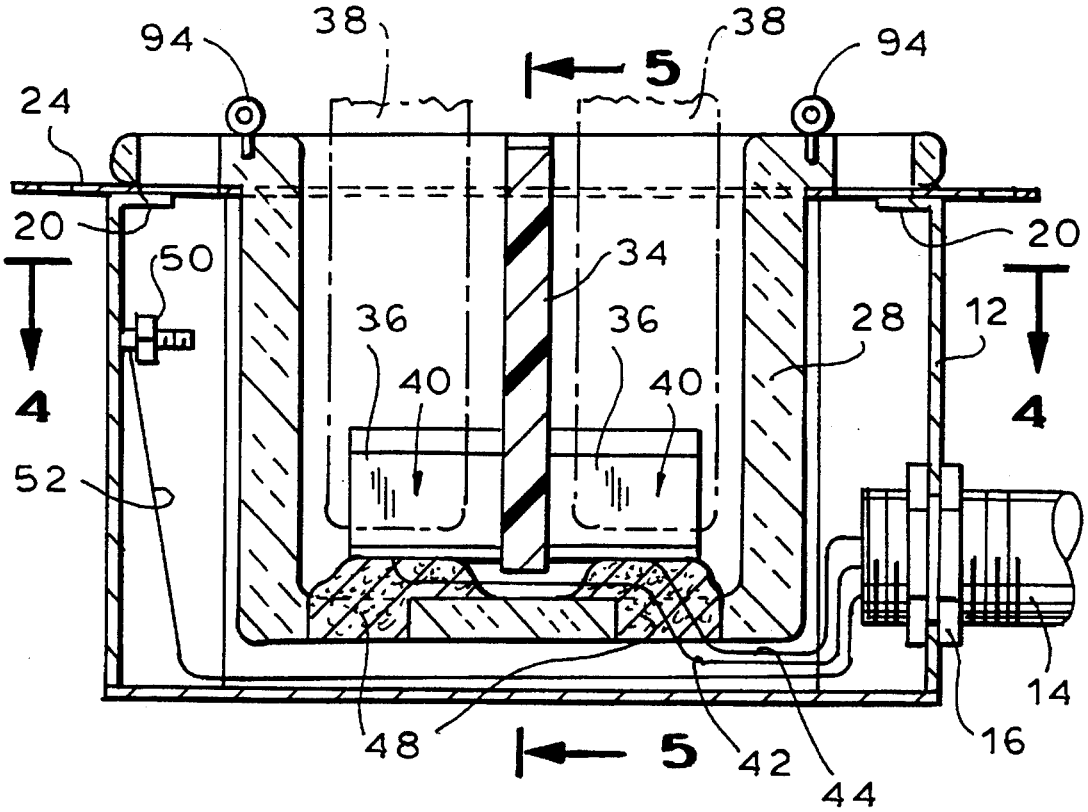
FIG. 3 is an elevation view in section take along line 3–3 of FIG. 1.
Figure 4:
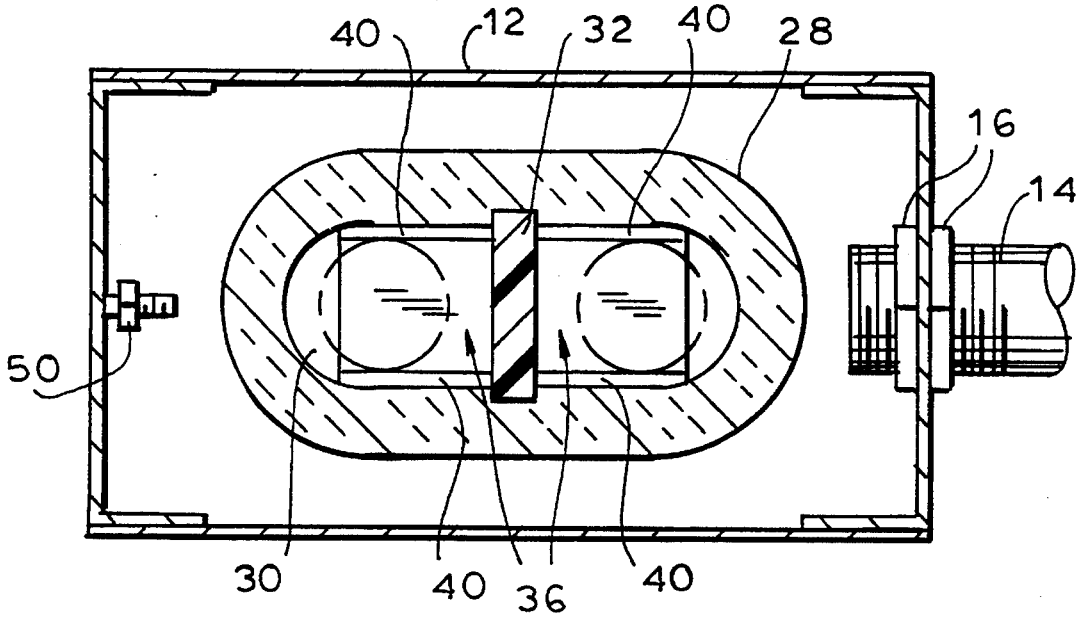
FIG. 4 is a top plan view in section taken along line 4–4 of FIG. 3.

In a preferred embodiment, as presented in FIGS. 1 through 5, the receptacle 28 includes a bulb end receiving aperture 30 which is generally rectangular in plan, with arcuate ends, as best seen in FIG. 4, dimensioned to accept the electrode ends of a pair of cold cathode lamp tubes aligned in parallel. The opposed parallel sides of the aperture are each provided with an aligned, vertically-extending notch or slot 32, extending the depth of the bulb-accepting aperture 26 and which accept an insulating divider plate 34 formed of phenolic or other insulating material, which may be permanently mounted within the aperture by use of an appropriate adhesive, such as epoxy.

Figure 5:
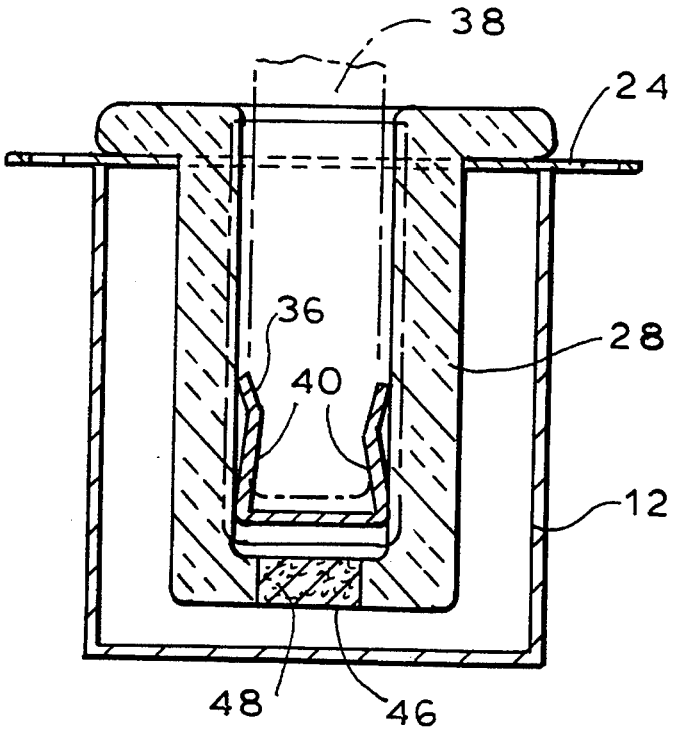
FIG. 5 is an end elevation view in section taken along line 5–5 of FIG. 3.

Mounted within the lower end of the aperture 30 on either sides of the divider plate 35 are a pair of generally U-shaped copper clips 36, each dimensioned to accept and firmly grasp the exposed electrode end of a cold cathode bulb 38, shown in phantom in FIG. 3. The width of the receptacle aperture 30 between its parallel sides is preferably incrementally greater than the diameter of the bulb ends, such that the clips 36 may be inserted with a friction-fit with the aperture sides to assist in maintaining the clips in position. In addition, the clip sides 40 may include an inward bias or bend, as best seen in FIG. 5, to provide a degree of flexure and tension between the clip sides and the inserted bulb. A pair of leads 42, 44 extend from the clips 36 through an aperture 46 in the bottom of the receptacle 28 for connection (not shown) within the box 12 with other leads located in the conduit 14 which may, for example, couple the bulbs to switching and/or power circuits. The aperture 46 is sealed with a silicone insulating compound 48 as known in the art. The insulating compound may be further utilized as an adhesive to maintain the clips in position within the receptacle 28. A ground lug 50 may be provided upon the interior of the box 12, and allows a ground lead 52 to be run as required through the connecting conduits 14.

The construction is completed by the inclusion of additional silicone beads and/or other appropriate sealants, as known in the art, to seal all apertures or holes in the completed structure to prohibit moisture entry. In the embodiment shown in FIGS. 1 through 5, each of the two cold cathode bulbs may be individually connected in a lighting circuit as required.

Figure 6:
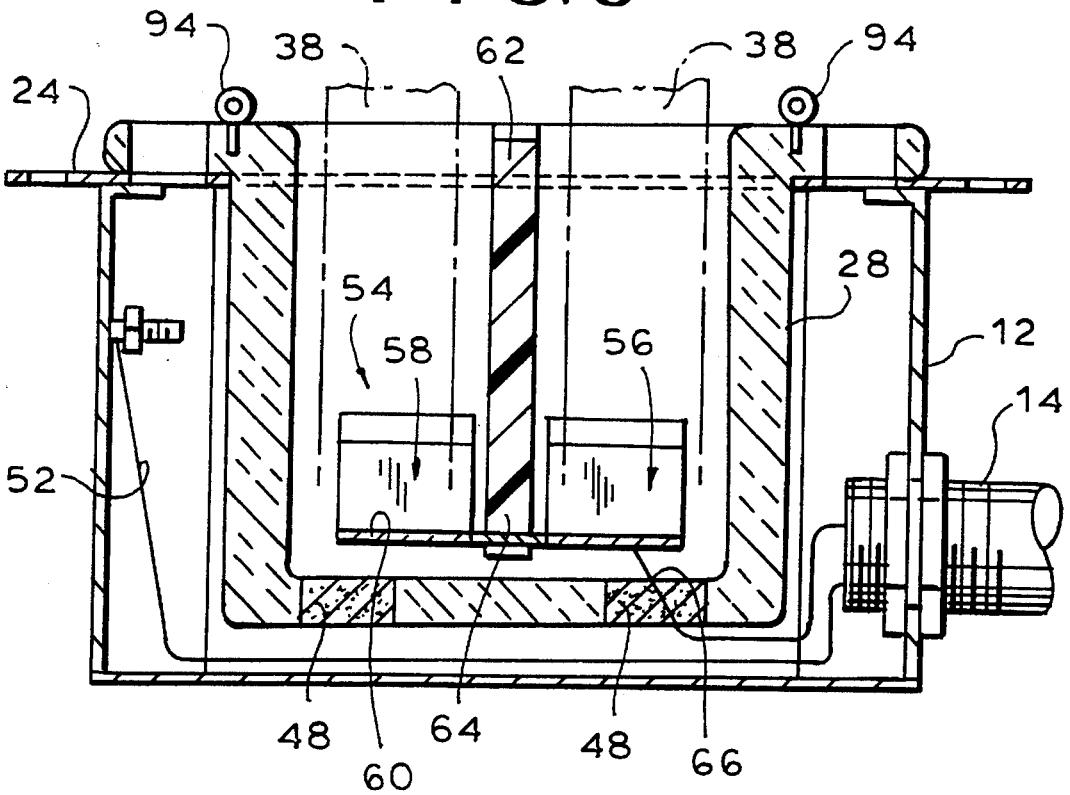
FIG. 6 is an elevation view in section taken along a line equivalent to line 3–3 in FIG. 1 representing a first alternative embodiment for the invention.

In the alternate embodiment detailed in FIG. 6, the lampholder is configured for integral parallel connection between the bulbs 38. As shown therein, a unitary dual clip assembly 54 incorporates first and second bulb end-gripping units 56, 58, respectively, extending upwardly from a common base 60. Insulating divider plate 62 is again retained by the side wall slots 32, but in this embodiment its lower end 64 rests upon the portion of the clip base 60 intermediate of the bulb-gripping portions 56 and 58. In this embodiment, a single lead 66 is provided to connect the clips and thus the bulb electrodes to additional circuit components. Upon construction, the apertures and seams are similarly sealed with appropriate compounds.

As depicted in FIG. 7, in a third embodiment of the present invention the lampholder 10 is adapted to accept either one or two bulbs, while providing protection against inadvertent contact with the unused electrical components when a single bulb is utilized. As shown therein, the bulb electrode clip 68 may include a pair of opposed unitary sides 70 to embrace bulbs inserted on both sides of the divider plate 72. The divider plate 72 itself extends downwardly within the side slots 32, terminating at the top edge of the electrode clip 68. A single lead 74 is provided to interconnect the clip to the remaining portions of the lighting circuit.

To convert from double to single bulb use, means are provided to block the portion of the access opening within the receptacle 28 which would otherwise expose the non-utilized portion of the electrode clip 68. Accordingly, a bracket 76 may be provided within the portion of the interior of the bulbholder associated with the unused bulb-accepting portion. The bracket 76 may take the form of a generally Z-shaped construction, a first arm 78 of which may be affixed to the electrode clip, a second arm 80 lying in a parallel plane exposes a threaded bore 82 perpendicular to the open end of the receptacle 28. An insulating bolt or other elongated element 84, having mating threads 86 at its distal end and an elongated head 88 at the opposed proximal end is provided, and maintains an insulating cover plate 90 in place upon the top of the receptacle 28 over the partial entranceway defined by the sides of the receptacle and the divider plate. The enlarged head 88 of the bolt applies downward pressure upon the cover about a provided throughbore 92 for the bolt. Thus configured, the lampholder may accept a single bulb for engagement with the electrode clip 68, while shielding the remaining portion of the clip from the environment. A pair of eyes 94 may be provided on the receptacle top surface in each of the embodiments to provide attachment points for strings which may be used to encircle or otherwise restrain installed bulbs to provide additional protection against the bulbs falling out of the receptacles.

As disclosed herein, the present invention provides for a new and unobvious lampholder having the ability to be configured for both single and dual bulb operation of cold cathode lighting circuits when such bulbs are arranged in a parallel configuration. As so designed, it permits such cold cathode lighting, and its attendant advantages, to be utilized in environments where series circuits utilizing such bulbs would be unacceptable.

I claim:

1. A cold cathode bulb lampholder for use in low-voltage parallel configuration lighting circuits, comprising:

a conductive housing having an internal grounding lug positioned therein;

an insulating receptacle mounted in said conductive housing, said receptacle having a bulb-accepting aperture dimensioned to accept electrode ends of two cold cathode bulbs and a bottom wall having at least one wire passage aperture therein;

an insulating divider plate mounted in said receptacle aperture partitioning said aperture into a pair of adjacent single bulb end receiving portions;

conductive electrode clip means mounted in each of said receiving portions;

lead means connected to said electrode clip means and passing through said at least one wire passage aperture in said receptacle into a space between said receptacle and said housing for interconnection with bulb wiring components;

and adhesive compound sealing means positioned within said at least one wire passage aperture and about said lead means passing therethrough and between said receptacle bottom wall and said conductive electrode clip means to provide a moisture-resistant wiring chamber between said receptacle and said housing and to assist in the support of said conductive electrode clip means.

2. The lampholder of claim 1, wherein said conductive electrode clip means comprise a unitary base and first and second pairs of opposed, electrode-engaging sides, a first of said pairs being located in a first receiving portion of said aperture and a second pair being located in a second receiving portion of said aperture; said insulating divider plate having a lower end extending between said first and second pairs.

3. The lampholder of claim 1, wherein said conductive electrode clip means comprise a unitary base and a pair of opposed electrode-engaging sides extending within said pair of bulb end-accepting portions, said insulating divider plate having a lower end terminating proximate a top edge of said sides.

4. The lampholder of claim 3 further including means for covering one of said pair of adjacent single bulb end-receiving portions.

5. The lampholder of claim 4, wherein said means for covering one of said end-receiving portions comprise a bracket mounted to said conductive electrode clip means mounted in said bulb end-receiving portion to be sealed, an insulating cover for said bulb end-receiving portion adapted to be mounted upon said receptacle; and an insulating fastener adapted to pass through said cover and threadingly engage said bracket to selectively maintain said cover on said receptacle.

6. The lampholder of claim 1, wherein said conductive electrode clip means comprise first and second clips, each comprising a base and a pair of spaced sides, one of said clips being mounted in a first receiving portion and the other of said clips being mounted in a second receiving portion of said aperture, said insulating divider plate extending within said receptacle aperture between said first and second clips.

* * * * *